US012012709B1

(12) United States Patent
Groves et al.

(10) Patent No.: US 12,012,709 B1
(45) Date of Patent: Jun. 18, 2024

(54) DOCK FLOAT ASSEMBLY

(71) Applicant: Olimax Inc., Freeland, WA (US)

(72) Inventors: Oliver J. Groves, Freeland, WA (US); Mark J. Groves, Meridian, ID (US); Shad James Groves, Long Beach, CA (US)

(73) Assignee: Olimax Inc, Freeland, WA (US)

( * ) Notice: Subject to any disclaimer, the term of this patent is extended or adjusted under 35 U.S.C. 154(b) by 0 days.

(21) Appl. No.: 18/370,148

(22) Filed: Sep. 19, 2023

Related U.S. Application Data

(60) Provisional application No. 63/407,918, filed on Sep. 19, 2022.

(51) Int. Cl.
*E02B 3/06* (2006.01)
*B63B 21/50* (2006.01)

(52) U.S. Cl.
CPC ..... *E02B 3/064* (2013.01); *B63B 21/507* (2013.01)

(58) Field of Classification Search
CPC ..... E02B 3/064; B63B 21/507
USPC ..... 114/263
See application file for complete search history.

(56) References Cited

U.S. PATENT DOCUMENTS

| | | | | |
|---|---|---|---|---|
| 2,600,761 | A * | 6/1952 | Halliburton | E02B 17/0809 405/197 |
| 3,672,178 | A | 6/1972 | Trautwein | |
| 3,695,207 | A | 10/1972 | Atlas | |
| 4,290,381 | A | 9/1981 | Penman | |
| 5,282,435 | A | 2/1994 | Chapman | |
| 5,823,715 | A | 10/1998 | Murdoch et al. | |
| 6,536,992 | B1 * | 3/2003 | Floe | E02B 3/068 405/218 |
| 7,103,935 | B2 | 9/2006 | Hill | |
| 7,287,484 | B2 | 10/2007 | Landry et al. | |
| 7,461,611 | B2 | 12/2008 | Hebden et al. | |
| 9,109,335 | B1 | 8/2015 | Groves | |
| 9,777,504 | B2 | 10/2017 | Levin | |
| 11,008,720 | B2 | 5/2021 | Kirby | |
| 2013/0087089 | A1 | 4/2013 | Lill | |

* cited by examiner

*Primary Examiner* — Anthony D Wiest
(74) *Attorney, Agent, or Firm* — Bold IP PLLC; Binita Singh

(57) ABSTRACT

The present disclosure is for an improved system for floating docks that allows the floating dock to maintain its float position with changing tides and/or water levels. The floating dock assembly includes an anchoring system and one or more floats. The one or more floats may be connected to one or more anchoring systems. Each anchoring system includes a post, a sleeve assembly, and an anchor weldment. Each anchoring system also uses a counterweight that is disposed within the post to keep a tension on a wire rope which is connected to the anchor weldment. The anchor weldment is placed in the ground where the floating dock is installed.

24 Claims, 9 Drawing Sheets

DOCK FLOAT ASSEMBLY

CROSS-REFERENCE TO RELATED APPLICATIONS

This application is a non-provisional application that claims the benefit of priority of U.S. provisional patent application No. 63/407,918, filed on Sep. 19, 2022, which is incorporated herein by reference.

FIELD OF THE DISCLOSURE

The present invention relates to docks for enabling passage between a naval vessel located on a body of water and a coast or bank or edge of the same body of water

BACKGROUND

A dock is a structure that is made for bringing boats, ships, or water aircrafts into the shore for loading or unloading them of passengers or goods. The dock is constructed to extend into the water from a shoreline to allow access to the vessel. Docks are either fixed or removable. Fixed docks include crib and suspension, with the former being damaging to the environment and the latter being difficult to remove even during severe weather events. Removable docks may consist of floating docks, piling docks, and pipe docks. In this category, some use wooden pilings that attach to the ground which make them not being able to adjust to rising or lowering water levels, and other floating docks being vulnerable to freezing and breaking in the winter, among other problems.

The type of property setting (i.e., ocean, river, lake, or pond) may decide the type of dock that can be placed. Docks placed in oceans and rivers must deal with strong currents and waves, and swift moving waters and fluctuating water levels. Often, a dock must also deal with high winds. Thus, a dock that can withstand these challenges and adjust with the movement of water is an important consideration and almost necessary. There are current methods that attempt to maintain a float position. An example includes the use of large diameter steel pipes or posts that vary in sizes and lengths. These pipes and posts have to position within the parameter of the float and require heavy equipment to install them deep into the seabed. Not only is it expensive, but also disruptive to the ecosystem around the dock. Over time, these posts may need to be replaced, which can again add to the cost and disrupt the ecosystem that may have established itself after the posts were installed.

Thus, there is still a need to improve on existing floating docks that can adapt well to strong currents, waves, swift moving waters, fluctuating water levels, and high winds, and which are not disruptive to the ecosystem.

SUMMARY

The present disclosure is for an improved system for docks, in particular floating docks. One or more embodiments are provided below for a floating dock assembly that can maintain its float position with changing tides. The floating dock assembly includes an anchoring system and one or more floats, wherein an aft float is proximal to the shoreline and is joined to a ramp which is connected to a bulkhead. The one or more floats can also include a forward float which is distal to the shoreline and may be connected to the aft float by a center float.

The one or more floats may be connected to one or more anchoring systems. Each anchoring system may include a post, a sleeve assembly, and an anchor weldment. Each anchoring system also uses a counterweight that keeps a tension on a wire rope. In one or more embodiments provided below, an aft float and a forward float may be connected to one or more anchoring systems. Each anchoring system uses a wire rope which is secured to both the anchor weldment and the counterweight. The anchor weldment is placed in the ground where the floating dock is to be installed, and the counterweight is disposed in the post which is directly connected to the one or more floats by the sleeve assembly. The post incudes a pulley system at a top end and which allows the wire rope to move with the counterweight within the vertical post. The counterweight maintains a tension on the wire rope as the tide and water level fluctuates which in turn secures the one or more floats in position on the body of water. Each of the one or more floats may have at least four anchoring systems that are each connected to their respective float by the sleeve assembly that allows the post to move vertically between the sleeve assemblies with the movement of the water. And having the float to be level prior to and when contacting the sea floor bottom allowing the post to remain in a vertical position. The anchor weldment includes a disc that screws into the sea bottom.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
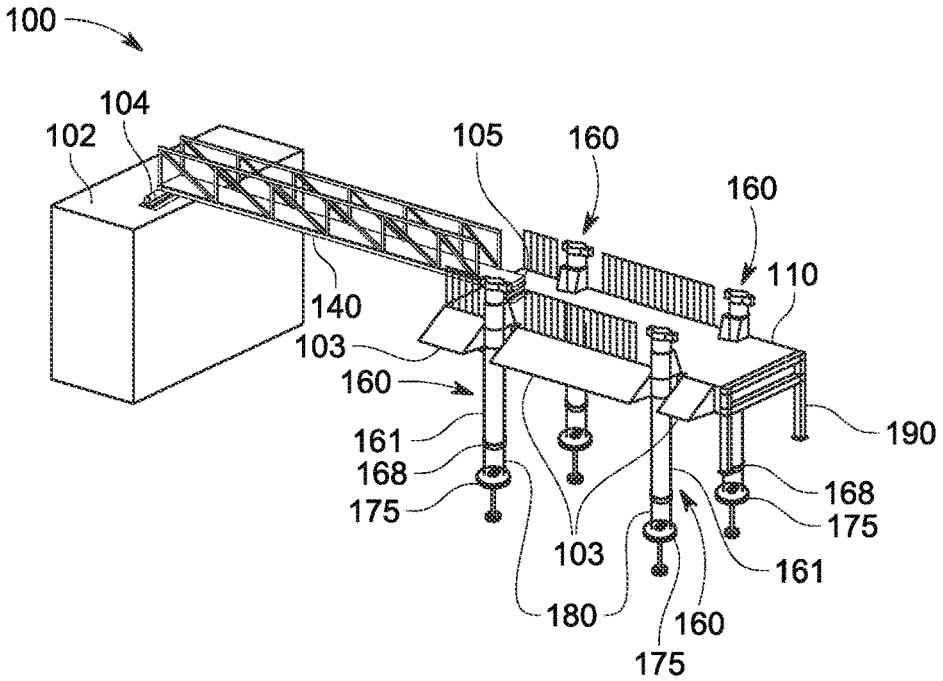
FIG. 1 is a pictorial illustration of a dock assembly in accordance with an illustrative embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

The present disclosure is generally drawn to one or more embodiments are for a floating dock assembly that can maintain a stable float position with the water level changes and changing tides. The floating dock assembly includes an anchoring system which has the advantage of allowing the floating dock assembly to maintain the stable float position. The disclosed system is easy to install and is minimally invasive and disruptive to the ecosystem in the vicinity of where the dock may be installed.

Figure 12:
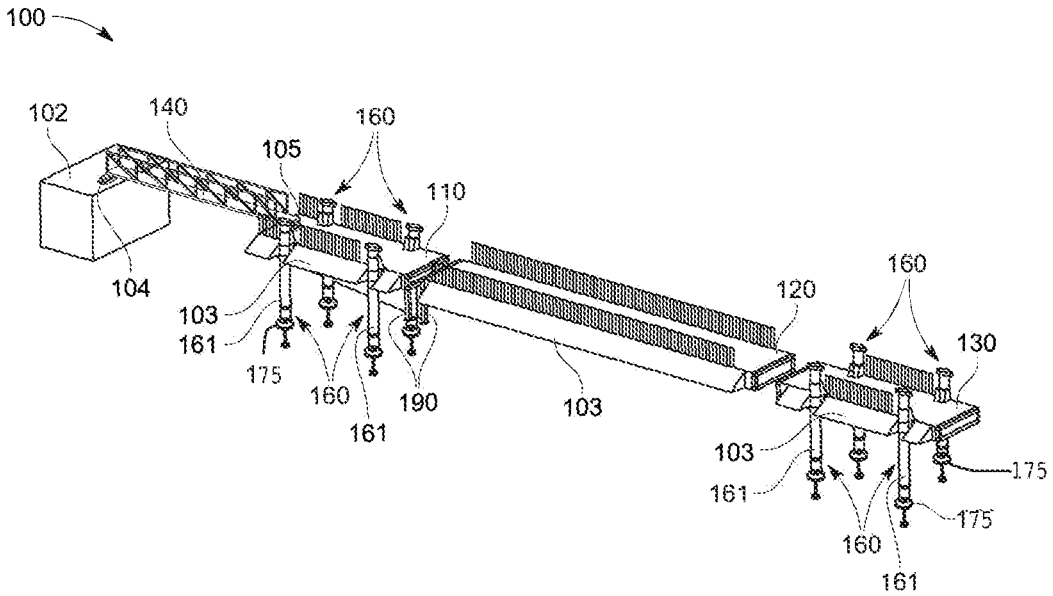
FIG. 12 is a pictorial illustration of a dock assembly including more than one float in accordance with an illustrative embodiment.

Turning to the figures, FIGS. 1 and 12 illustrate example embodiments of a floating dock assembly 100 which may include one or more floats 110, 120, 130 and an anchoring system 160. It is noted that the floating dock assembly 100 may be interchangeably used with the words "dock assembly" or "floating dock" for purposes of brevity.

FIG. 1 is an illustration of a perspective view of the floating dock assembly 100 which is shown to include a single float, referred to as an aft float 110, wherein the aft float 110 is proximal to a shoreline. The dock assembly 100 is shown to include a ramp 140 connected to a bulkhead 102 and, on the opposite side of the ramp 140, the aft float 110. The ramp 140 has a first aft end and a first forward end wherein the first aft end is connected to the bulkhead 102. The aft float 110 has a second aft end and a second forward end, wherein the second aft end on the aft float 110 is connected to the ramp 140 at the first forward end. The anchoring system 160 is included on the aft float 110. Additionally, a float leveling assembly 190 is also included on a second forward end on the aft float 110.

FIG. 12 is an illustration of a perspective view of the floating dock assembly 100 including the aft float 110, a center float 120, and a forward float 130. The forward float 130 is distal to the shoreline and is connected to the aft float 110 by the center float 120. The dock assembly 100 is shown to include the ramp 140 connected to the bulkhead 102, the aft float 110 connected to the ramp 140, and the forward float 130 connected to the aft float 110 via the center float 120. The center float 120 has a third aft end and a third forward end, where the third aft end is connected to the aft float 110 at the second forward end. The forward float 130 has a fourth aft end and a fourth forward end, where the fourth aft end is connected to the center float 120 at the third forward end. The aft float 110 is intended to be closest to a shoreline and the forward float 130 is intended to be furthest away from a shoreline. Thus, for each float, the aft end is an end closest to the shoreline and the forward end on each float is an end that is furthest away from the shoreline.

Figure 9:
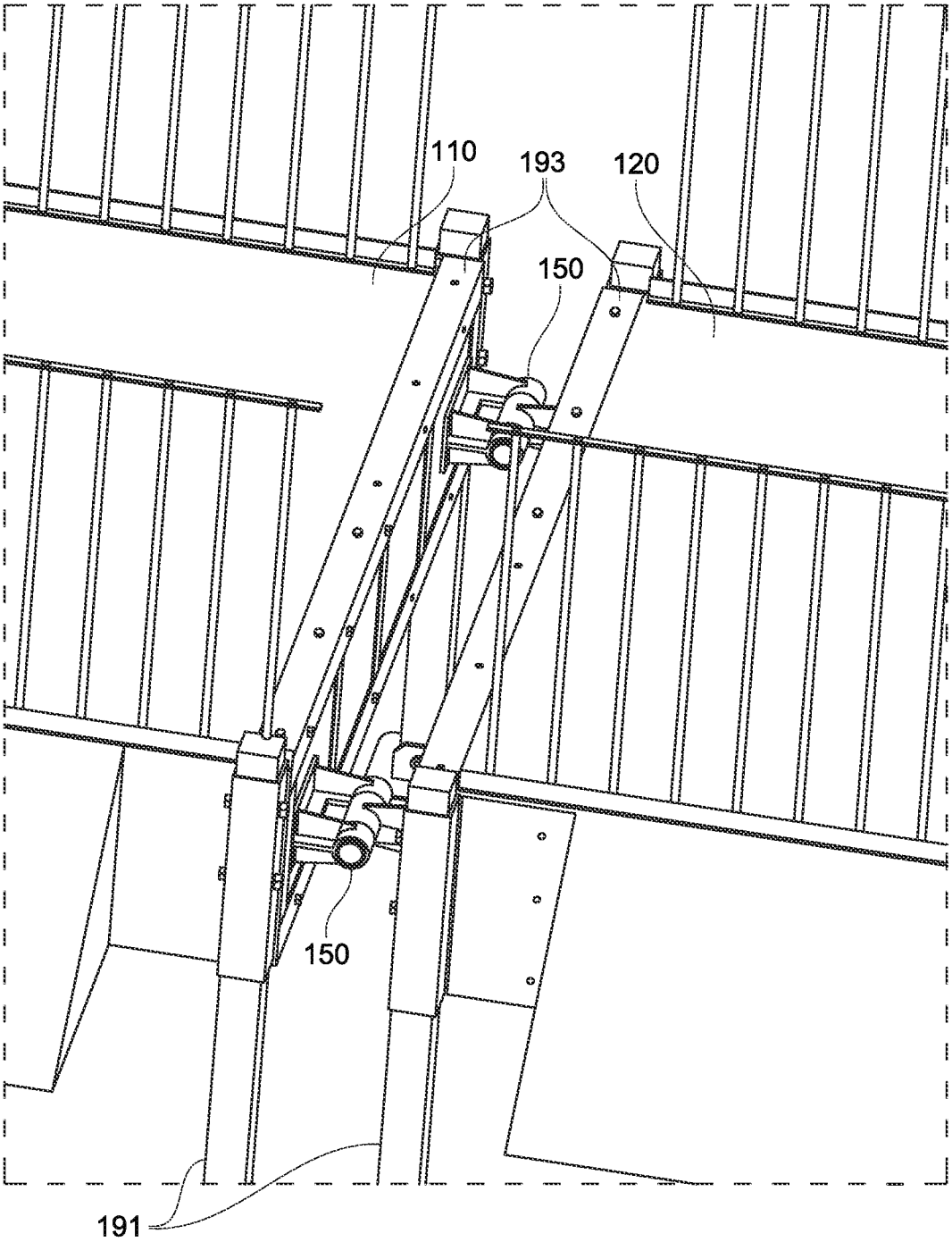
FIG. 9 is a pictorial illustration of a close-up view of one or more float leveling assemblies and one or more connection assemblies in accordance with an illustrative embodiment.

In FIG. 12 the dock assembly 100 is also shown to include the anchoring system 160 on both the aft float 110 and the forward float 130. The float leveling assembly 190 is also included on the aft float 110 and the center float 120. Specifically, the float leveling assembly 190 is included on each the second forward end on the aft float 110, the third aft end the center float 120. FIG. 9 is a close-up view illustrating the float leveling assembly 190 on the second forward end on the aft float 110 and the third aft end of the center float 120.

Figure 10:
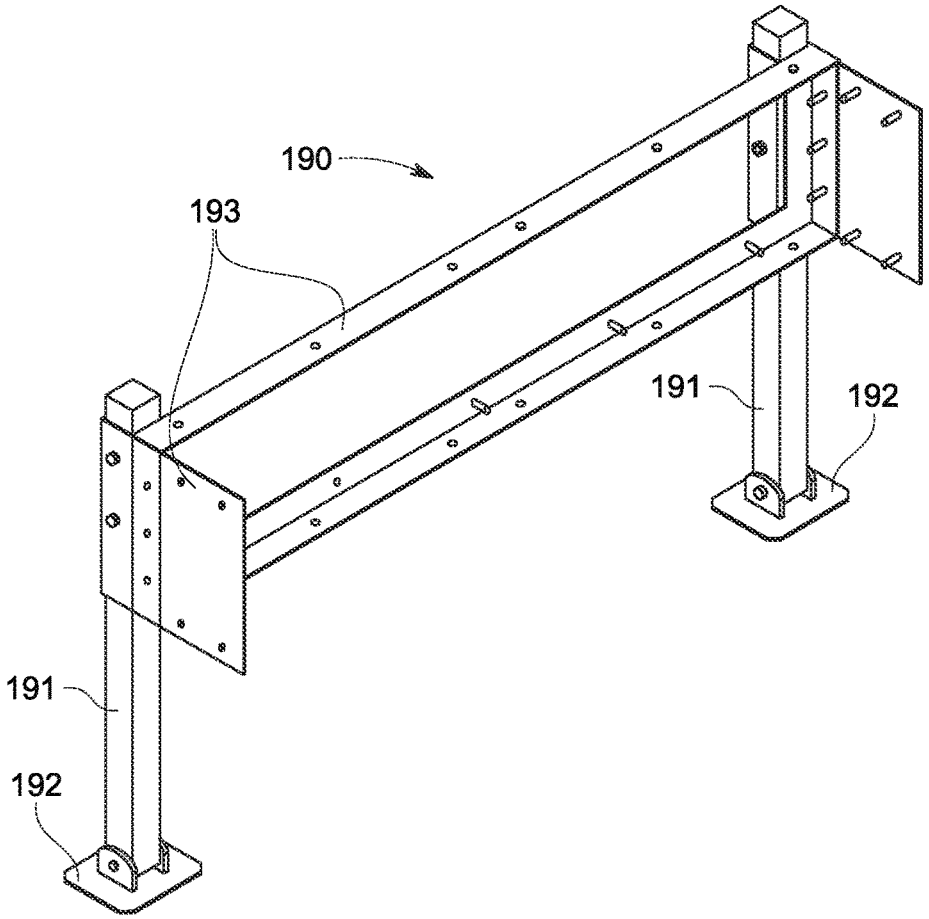
FIG. 10 is a pictorial illustration of a stand-alone float leveling assembly in accordance with an illustrative embodiment.

The float leveling assembly 190 on each of the aft float 110 and the center float 120 allows for a leveling of each of the floats 110, 120, 130 to be vertical during an installation of the floating dock 100 and also during low tide. The float leveling assembly 190 is connected to each of the aft and center floats 110,120 by any means known in the arts, such as by welding or bolts. FIG. 10 depicts a standalone float leveling assembly 190 that can be attached to the one or more floats 110, 120. As can be seen, the float leveling assembly 190 includes a bracket 193 that attaches to an end and side of the respective float (110, 120). At least two legs 191 with pivoting feet 192 extend down from the bracket 193 that allows the float leveling assembly 190 to remain vertical when placed on the ground. The legs 191 extend perpendicularly down from the one or more floats (110, 120) the float leveling assembly 190 is connected to.

The first aft end on the ramp 140 is joined to the bulkhead 102 by a first locking mechanism 104 which enables the ramp 140 to rotate with respect to the bulkhead 102 around a first horizontal axis. The horizontal axis is perpendicular to a long axis of the ramp 140. Alternative embodiments may include a first locking mechanism that includes a hinge joined to the ramp and the bulkhead. The first forward end of the ramp 110 is attached to the second aft end on the aft float 110 by a second locking mechanism 105. The second locking mechanism 105 enables the aft float 110 to rotate with respect to the ramp 140 around a second horizontal axis, which is also perpendicular to the long axis of the ramp 140.

Further, as illustrated in FIG. 12 the aft float 110 and the forward float 130 are connected to the center float 120 by one or more connecting assemblies 150. The connection assemblies 150 enables the aft float 110 and the center float 120 to rotate relative to each other about a horizontal axis (i.e., the floats rotate up and down with the tide movement). Further, the one or more connection assemblies 150 also enable the forward float 130 and the center float 120 to rotate relative to each other about a horizontal axis. To this end, the one or more connection assemblies 150 provide a gap between the aft float 110 and the center float 120, and a gap between the forward float 130 and the center float 120 allowing for the relative rotations about the respective horizontal axes. FIG. 9 illustrates one such closeup view of the connection assembly as attached to the aft float 110 and the center float 120.

Figure 11:
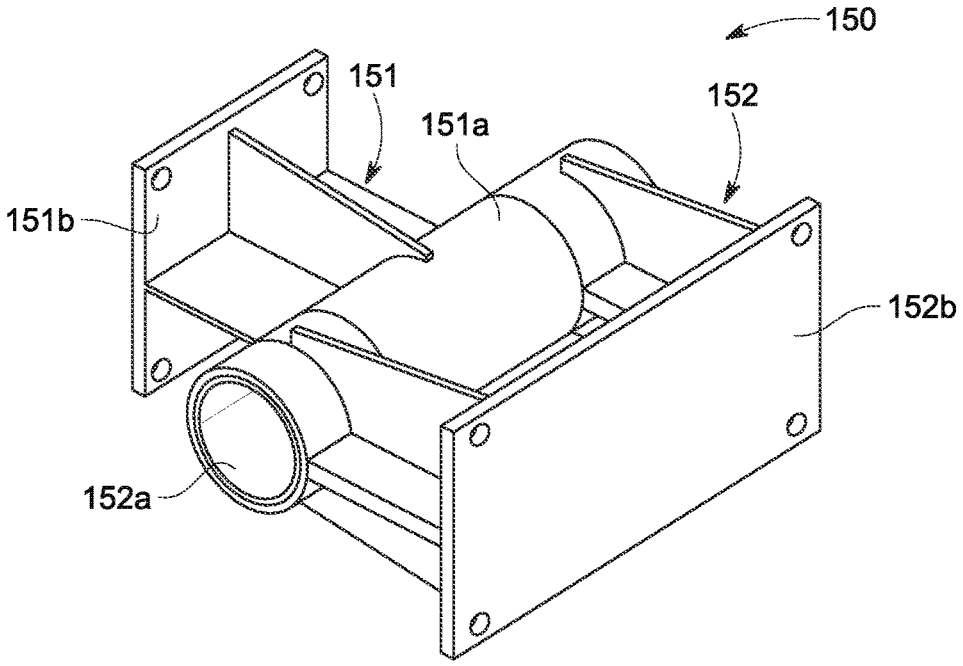
FIG. 11 is a pictorial illustration of a stand-alone connection assembly in accordance with an illustrative embodiment.

FIG. 11 illustrates a standalone connection assembly 150 which includes of two pieces, a first piece 151 and a second piece 152, that function as a hinge allowing the rotation along the horizontal axis. The two pieces 151, 152 each include a tubular piece, a first tubular piece 151*a* and a second tubular piece 152*a*, that engage with each other for rotation. As can be seen, the second tubular piece 152*a* has a smaller diameter and fits within the first tubular piece 151*a*. It is to be understood that alternatively, the first tubular piece 151*a* may have a smaller diameter and fit within the second tubular piece 152*a*. Each of the first and second pieces 151, 152 includes an attachment end 151*b*, 152*b* that attaches to their respective float to form the connection assembly 150. As an example, the first piece 151 may attach to the aft float 110 at the second forward end and the second piece 152 may attach to the center float 120 at the third aft end to allow the aft float 110 and the center float 120 to rotate relative to each other. In FIG. 9, the aft float 110 and the center float 120 are connected to each other by two connection assemblies. It is to be understood that one or more connection assemblies 150 can be used depending on a size of the one or more floats to be connected.

In the embodiment shown in FIG. 1, the first locking mechanism 104 and the second locking mechanisms enable the pitching of the ramp 140 with respect to the bulkhead 102 and the pitching of the aft float 110 with respect to the ramp 140 to ensure that the floating dock assembly 100 is not rigid along its whole length. The same configuration is included in the embodiment shown in FIG. 12. In addition, the embodiment in FIG. 12 also includes the connection assemblies 150 between the center float 120 and the aft float 110, and the center float 120 and the forward float 130. This also ensures that the dock assembly 100 of FIG. 12 is not rigid along its whole length. In this manner, the dock assembly 100 is configured for adapting its geometry to the motion of the water in the body of water and for decreasing the risk of damage to the dock assembly 100 by the motion of water.

In FIG. 1, the anchoring system 160 is configured and connected to the aft float 110 providing a way to secure the aft float 110 to a sea bottom, and thus secure and maintain the dock assembly 100 in position when water levels and tides change. The anchoring system 160 is positioned level on the sea floor when the tide is low. As seen in FIG. 12, the anchoring system 160 is configured and connected to the aft float 110 and the forward float 130, providing a way to secure both the aft and forward floats 110, 130 and thus securing the dock assembly 100 to maintain a position on the water with the water level and tide changes. The dock assembly 100 consists of at least four (4) anchoring systems 160 that are attached to the aft float 110 and at least four (4) anchoring systems 160 that are attached to the forward float 130. In the embodiments shown in FIGS. 1 and 11, the aft float 110 and the forward float 130 are each shown to be attached to four (4) anchoring systems 160.

Figure 2:
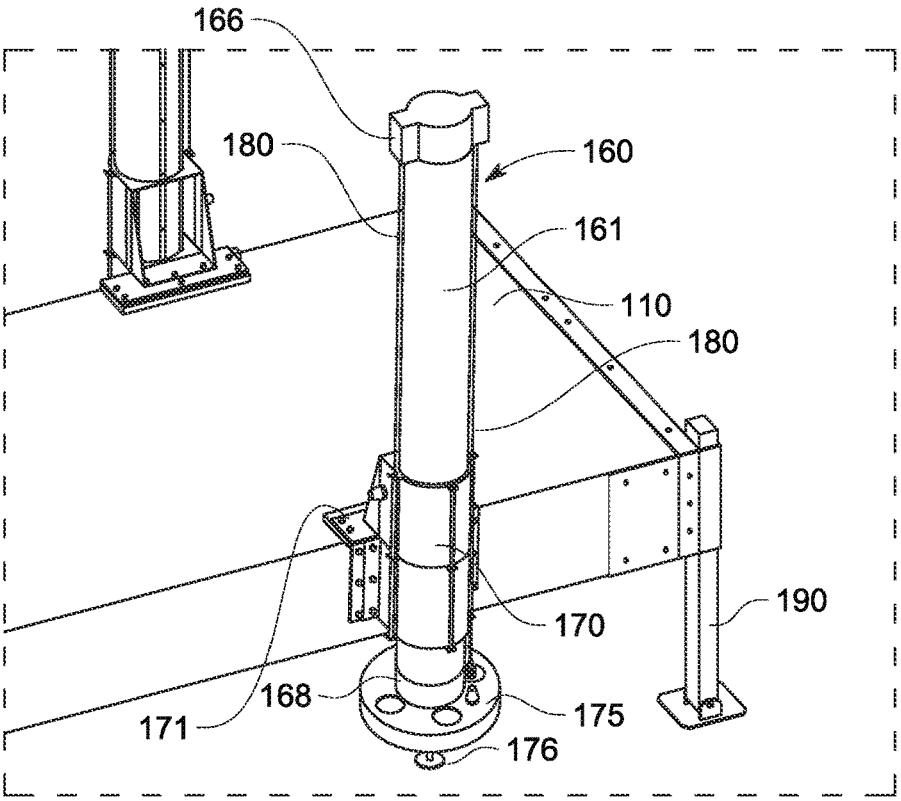
FIG. 2 is a pictorial illustration of an anchoring system of the dock assembly in in accordance with an illustrative embodiment.
Figure 3A:
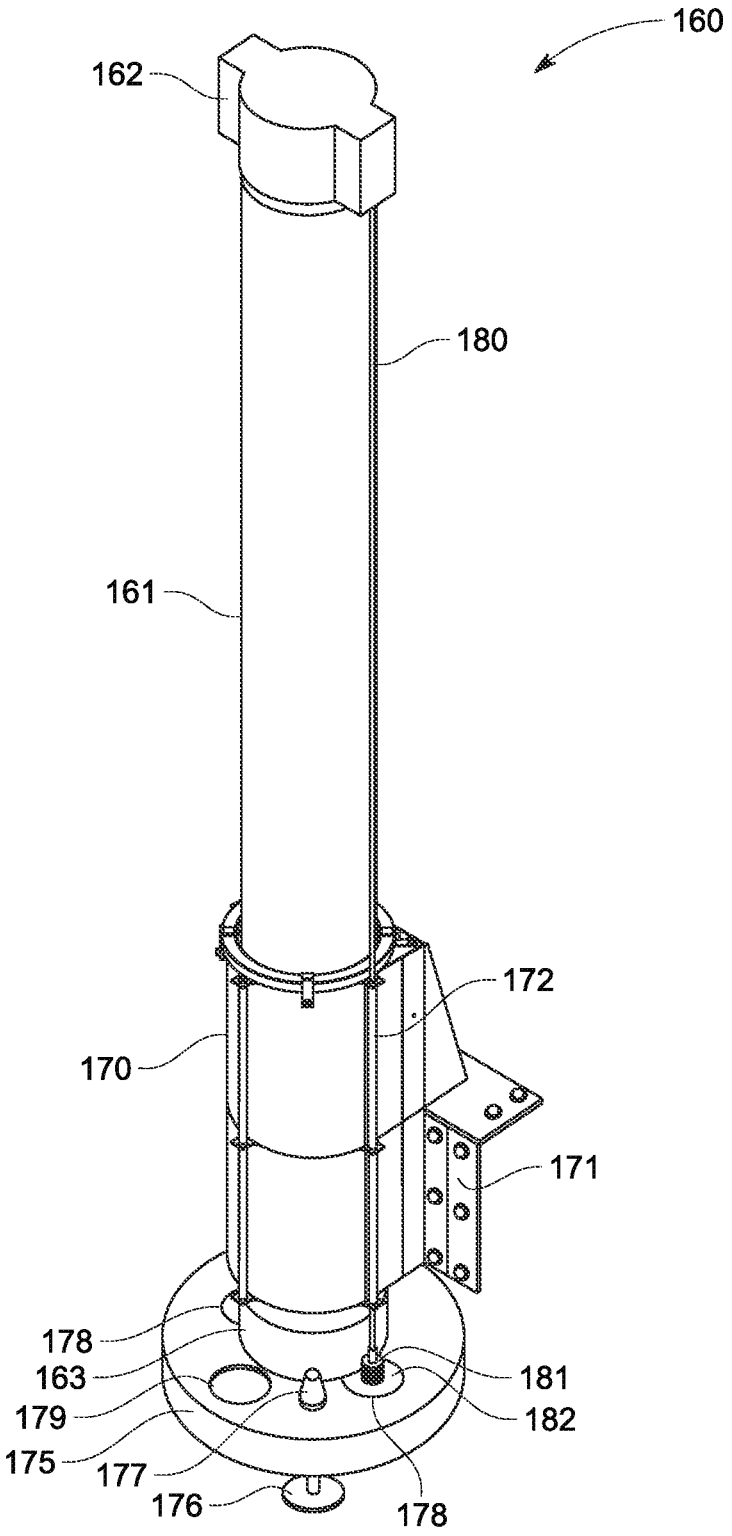
FIG. 3A is a pictorial illustration of the anchoring assembly I a lowest vertical position with a post positioned upward in a sleeve assembly of the anchoring system in accordance with an illustrative embodiment.
Figure 3B:
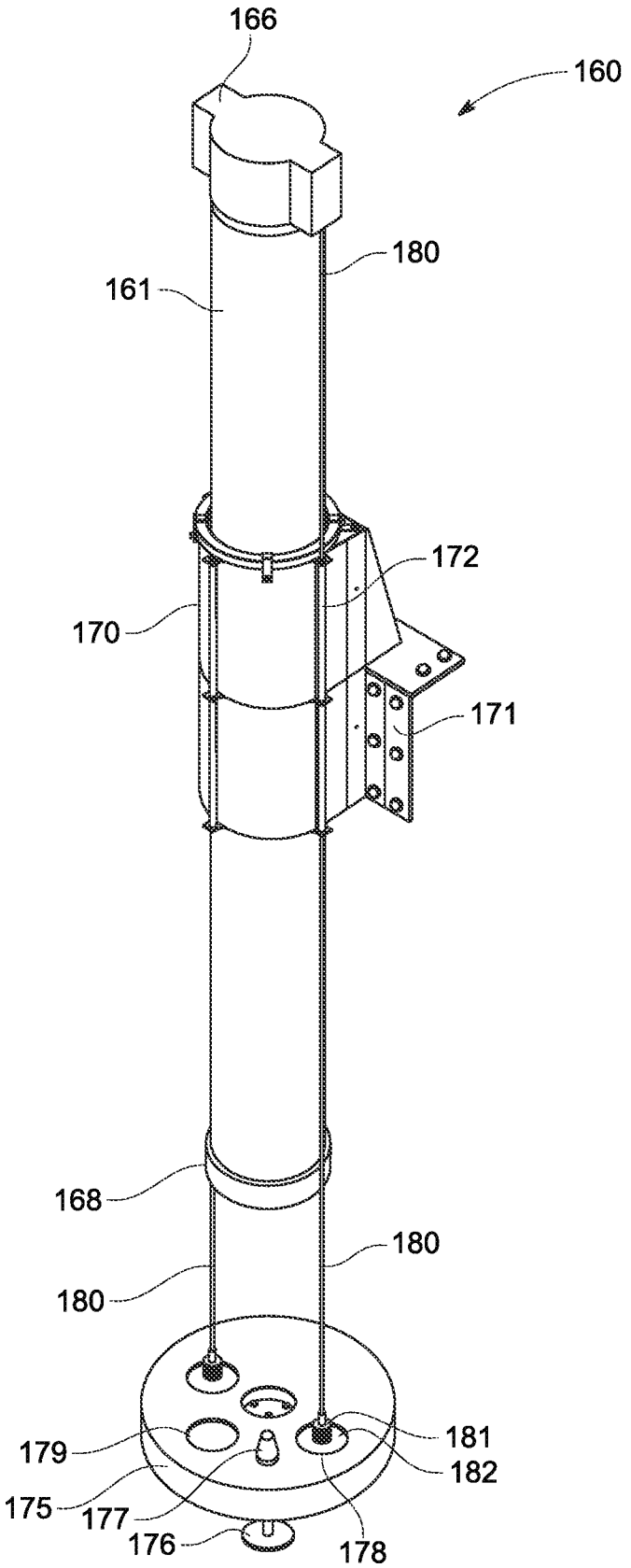
FIG. 3B a pictorial illustration of the anchoring assembly in a normal vertical position with the post positioned lower in the sleeve assembly of the anchoring system in accordance with an illustrative embodiment.

FIGS. 2, 3A, and 3B illustrate a close-up view of a single anchoring system 160 that may be attached to the aft float 110 and the forward float 130 on the dock assembly 100. The subsequent discussion will be focused on a single anchoring system 160, but it should be readily understood that the discussion applies to each anchoring system 160 that comprises the floating dock 100. As shown in the figures, the anchoring system 160 comprises a post 161, a sleeve assembly 170, and an anchor weldment assembly which includes a disc 175 and a screw shaft 176. The anchor weldment assembly allows the anchoring system 160 to be anchored to the ground. The anchoring system 160 is also connected to the aft float 110 and/or the forward float 130 by the post positioning assembly 170.

Referring to the anchor weldment assembly, a bottom surface of the disc 175 is connected to the screw shaft 176 which extends perpendicularly away from a center of the disc 175. The screw shaft 176 may be configured as part of the disc 175 or the screw shaft 176 may be secured onto the disc 175 by any means that creates a strong bond, such as welding or bolts. An example attachment will be described below. The screw shaft 176 is configured to be positioned into the ground. The screw shaft 176 has one or more threads opposite an end connected to the disc 175. The one or more threads allow the screw shaft 176 to be pushed into the ground with some rotational force. An example of a device providing some rotational force may include an Auger machine. It is also to be understood that the screw shaft 176 may be positioned into a hole dug into the ground. The disc 175 may have a conical shape starting from a top and tapered down by a few inches, e.g., 3 inches. The disc 175 engages with the earth when the screw shaft 176 is positioned into the ground. The disc 175 may further include an anode 177 on a top surface of the disc 175 to prevent electrolysis.

Figure 7:
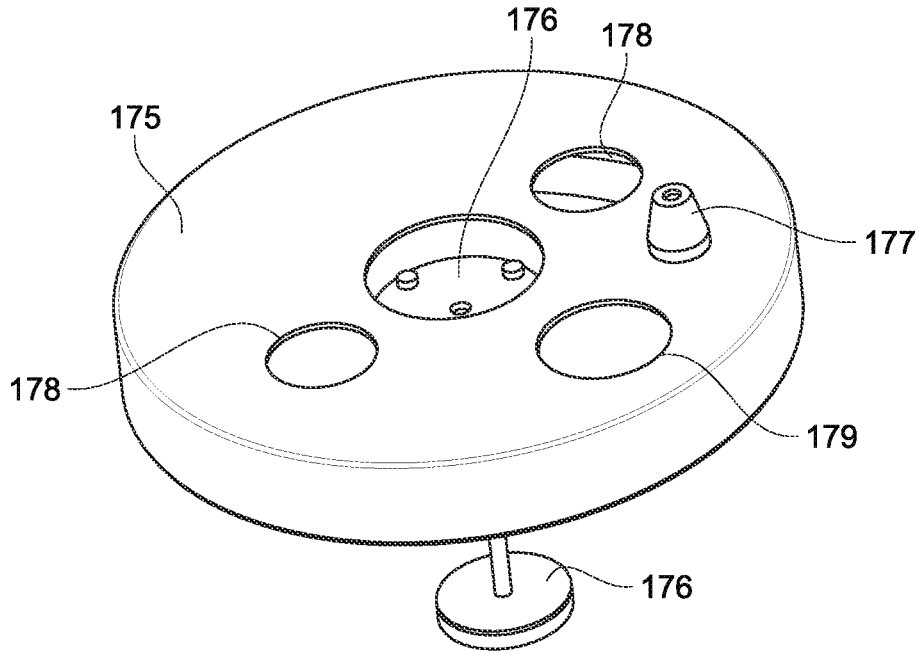
FIG. 7 is a pictorial illustration of a disc with a screw comprising part of an anchor weldment in accordance with an illustrative embodiment.

FIG. 7 is an illustration of the disc 175 depicting certain features. As can be seen, the disc 175 includes several openings on the top surface. A pair of openings, referred to as fitting openings 178, are opposite each other from the center of the disc 175 where the screw shaft 176 is connected. A pair of anchor blocks 182 are disposed within each of the anchor fitting openings 178. The disc 175 is secured into the ground with the anchor blocks 182 underneath the disc 175 and exposed through the fitting openings 178. Further, each of the pair of anchor blocks 182 is connected to a wire rope fitting 181 which extends upward from a top surface of the disc 175. Each of the wire rope fittings 181 connects to a wire rope 180, which will be explained in more detail later. Another opening in the disc 175, referred to as a pour hole 179, is used to pour concrete into when the disc 175 is inserted into the ground and is fitted over the anchor blocks 182 allowing a secure connection.

FIGS. 2, 3A, and 3B also illustrate the post 161 positioned through the sleeve assembly 170 that is connected to the aft float and/or the forward float 110, 130. The post 161 is a hollow tubular structure having a top end and a bottom end, wherein the top end is covered with a pulley cover 166 and the bottom end faces toward the top surface of the disc 175. The bottom end of the post 161 is closed off with a plate and further a protective cover 168 is placed over the bottom end of the post 161. The protective cover 168 surrounds the bottom end and sides of the post 161 to prevent any abrasion as the post 161 slides within the sleeve assembly 170 during water level and tide changes. The protective cover 168 may be fashioned from stainless steel.

The post 161 may have a circular cross-section, but may also be chosen from a square, rectangle, triangle, oval, or other shape cross-sections. The post 161 may have a length and a diameter that is commensurate with a size of the one or more floats the anchoring system 160 is connected to and which allows for the float to maintain a position with the tides which may change up or down 14 feet. It is to be understood that the post 161 may be chosen from different lengths depending on where the dock assembly 100 may be installed. Thus, as an example, the post 161 may have a length of fourteen (14) feet and an outside diameter of thirteen (13) inches. As seen in FIG. 12, the forward float 130 has an anchoring system 160 with posts 161 that are illustratively longer in length than the posts 161 on the aft float 110. It will be readily understood by a person skilled in the arts, that the forward float 130 will be positioned further away from the shoreline and thus positioned at a point in the water that has a greater depth and further requiring a longer length of the wire rope 180.

The post 161 is connected to the aft float 110 or the forward float 130 by the sleeve assembly 170 which is mounted to the aft float 110 or the forward float 130 by a support plate 171. The support plate 171 may be configured as part of the sleeve assembly 170 or may be attached to the support plate 171 via any securing means known in the arts, such as welding or bolts. The support plate 171 is attached to the aft float 110 or the forward float 130 along a top and side surface of the respective float the anchor assemblies 160 are connected to. The sleeve assembly 170 has a shape that is commensurate with the shape of the post such that the post 161 can be slidingly placed through the sleeve assembly 170. The post 161 is placed through the sleeve assembly 170 aligning the post 161 and thus allowing the sleeve assembly 170 to move vertically along a length of the post 161 during and throughout the water level and tide changes.

Figure 8:
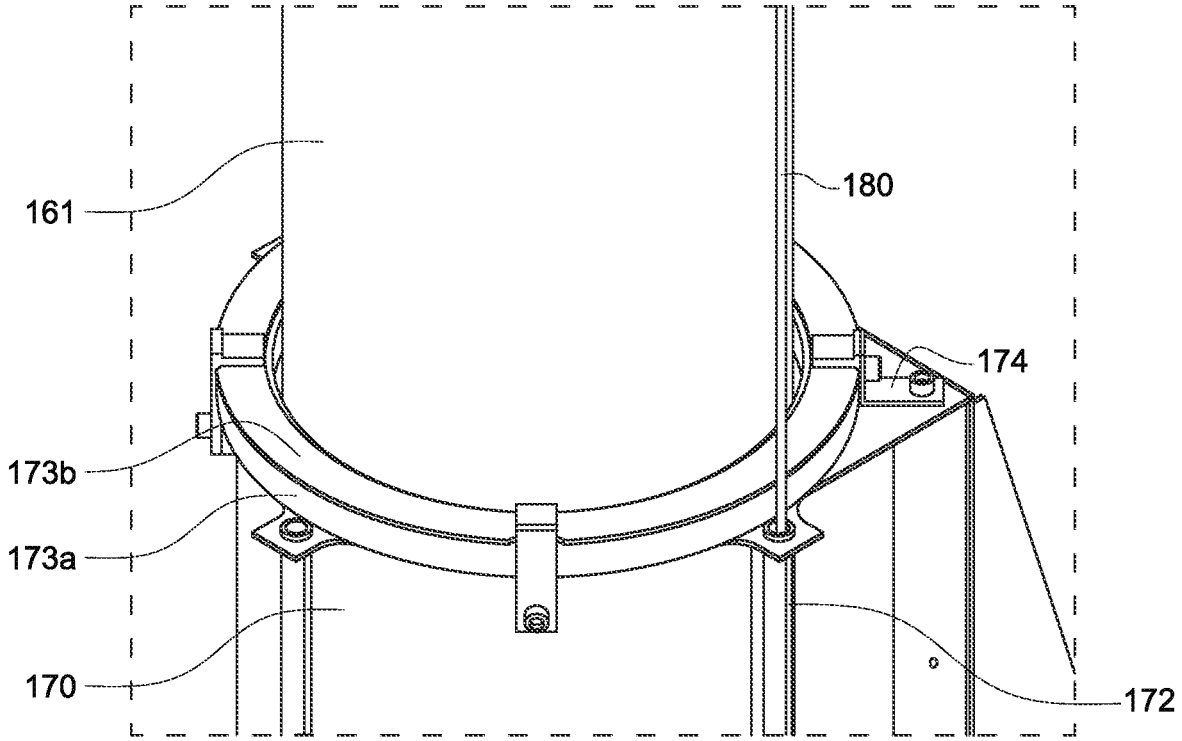
FIG. 8 is a pictorial illustration of a ring alignment assembly which is positioned on a top of the sleeve assembly in accordance with an illustrative embodiment.

In FIG. 8, a close-up view of the post 161 positioned through the sleeve assembly 170 is shown. A top end of the sleeve assembly 170 includes a synthetic resin ring 173*a*, such as a polytetrafluoroethylene. The resin ring 173*a* has a metal ring 173*b* on a top surface that holds the resin ring 173*a* which are both connected to the sleeve assembly 170 by one or more brackets 174. The resin ring 173*a* is positioned between the top surface of the sleeve assembly 170 and the metal ring 173*b* and has a diameter that is slightly smaller than a diameter of both the sleeve assembly 170 and the metal ring 173*b*. In this configuration, the post 170 will bump and rub against the resin ring 173*a* and prevent abrasion of the post 161 against the sleeve assembly 170. This way the post 161 bumps against the resin ring 173*a* which is soft and does not damage the post 161.

Figure 6:
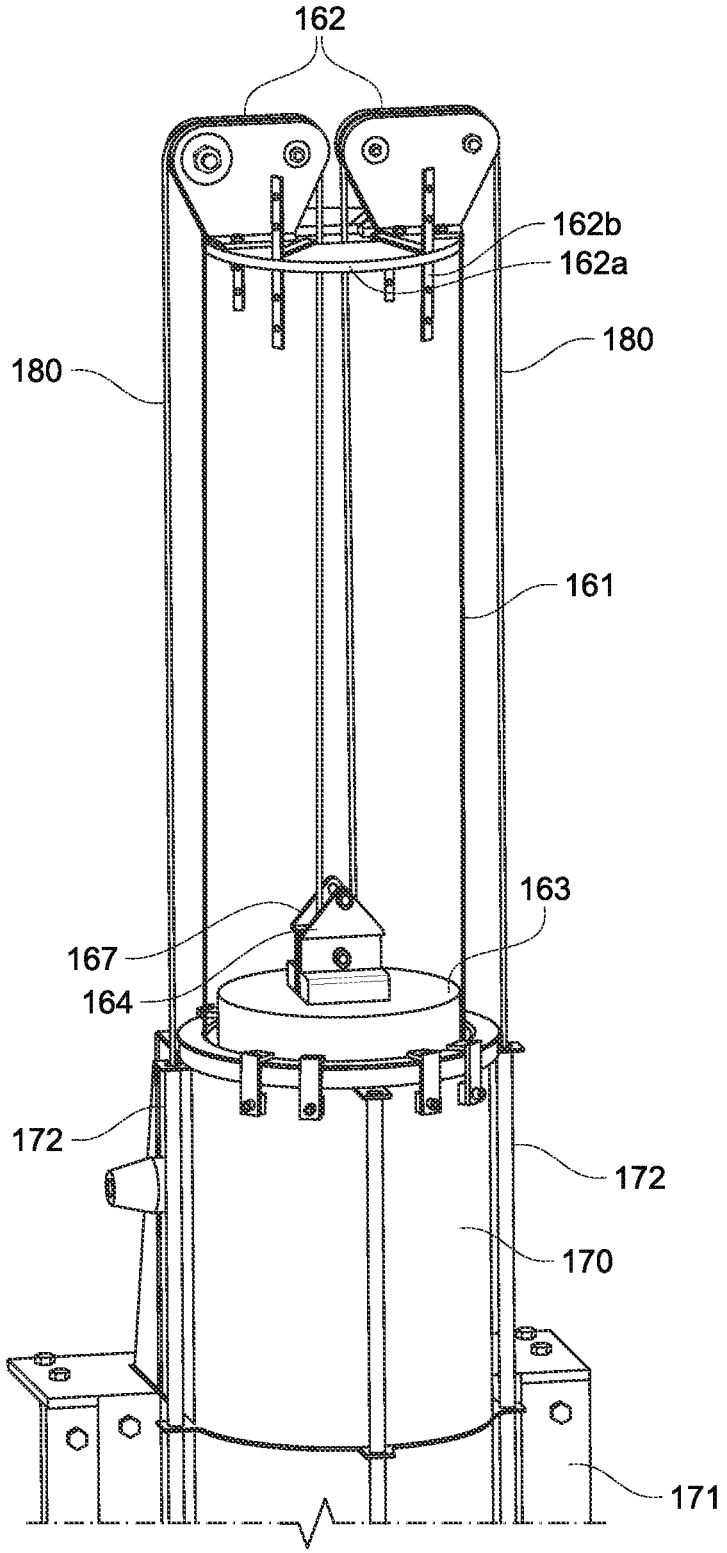
FIG. 6 is a pictorial illustration of part of the anchoring system with a transparent view of the post in accordance with an illustrative embodiment.

As best seen in FIG. 6, the sleeve assembly 170 also includes two thin tubes 172 that are configured opposite each other along an outside surface of the sleeve assembly 170. The thin tubes 172 may be configured along an entire length of the sleeve assembly 170 and are configured to accommodate the wire rope 180. The wire rope 180 is passed through each thin tube 172 and connected to the wire rope fittings 181. As will be discussed later, the wire rope 180 is placed through a first thin tube 172 upward toward the top end of the post 161, down through the post 161 to the counterweight 163 and back up toward the top end of the post 161, and then toward the disc 175 through the second thin tube 172 on the sleeve assembly 170 and finally connecting to the wire rope fitting 181 on the opposite side. The thin tubes 172 ensure that the wire rope 180 is supported through the sleeve assembly 170.

In FIG. 1, each post 161 is positioned within a sleeve assembly 170 which secures the post 161 to the aft float 110. In FIG. 12, the posts 161 are also secured to the forward float 130. Thus, during water level and tide changes, the sleeve assembly 171 and the post 161 interaction will allow the aft float 110 and/or the forward float 130 to adjust along with the water level and tide changes. The post 161 is allowed to freely move up or down within the sleeve assembly 170. A locking ring (not shown) is positioned into a groove around the post which prevents the post 161 from dropping through the sleeve assembly 170. Additionally, the post 161 also includes a slot (not shown) along a length of the post 161 that fits within a connector on an inside of the sleeve assembly 170 to ensure that the post 161 does not rotate and thus prevents the wire rope 180 from entanglement.

Figure 4:
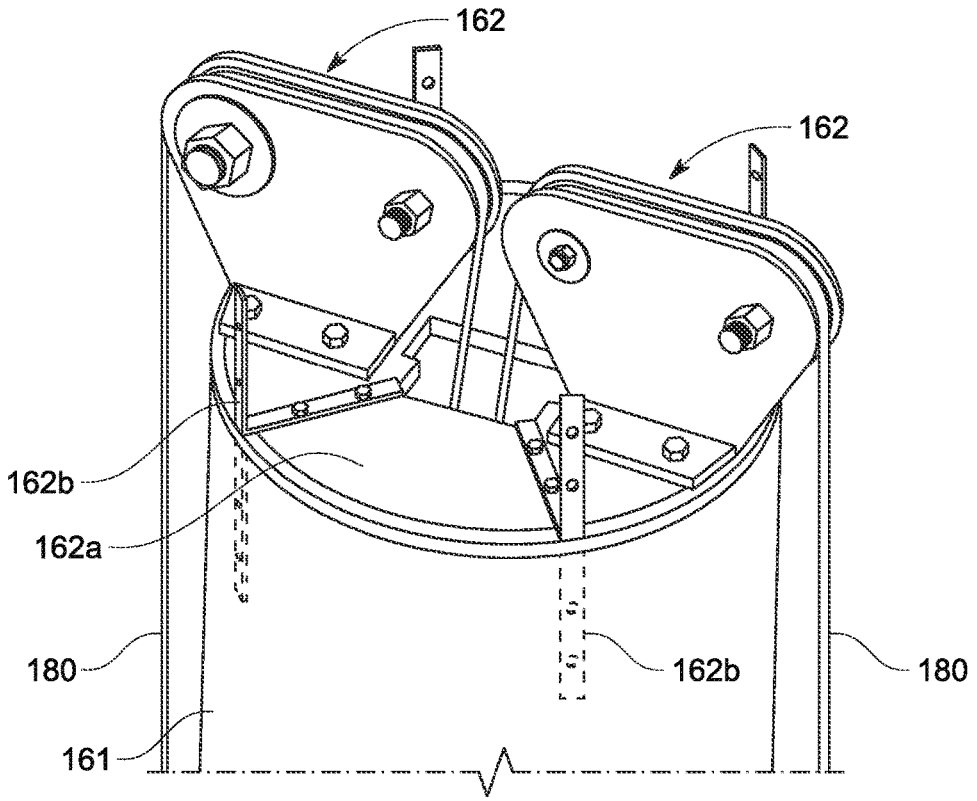
FIG. 4 is a pictorial illustration of a top end of the post with a pulley system comprising the anchoring system in accordance with an illustrative embodiment.
Figure 5:
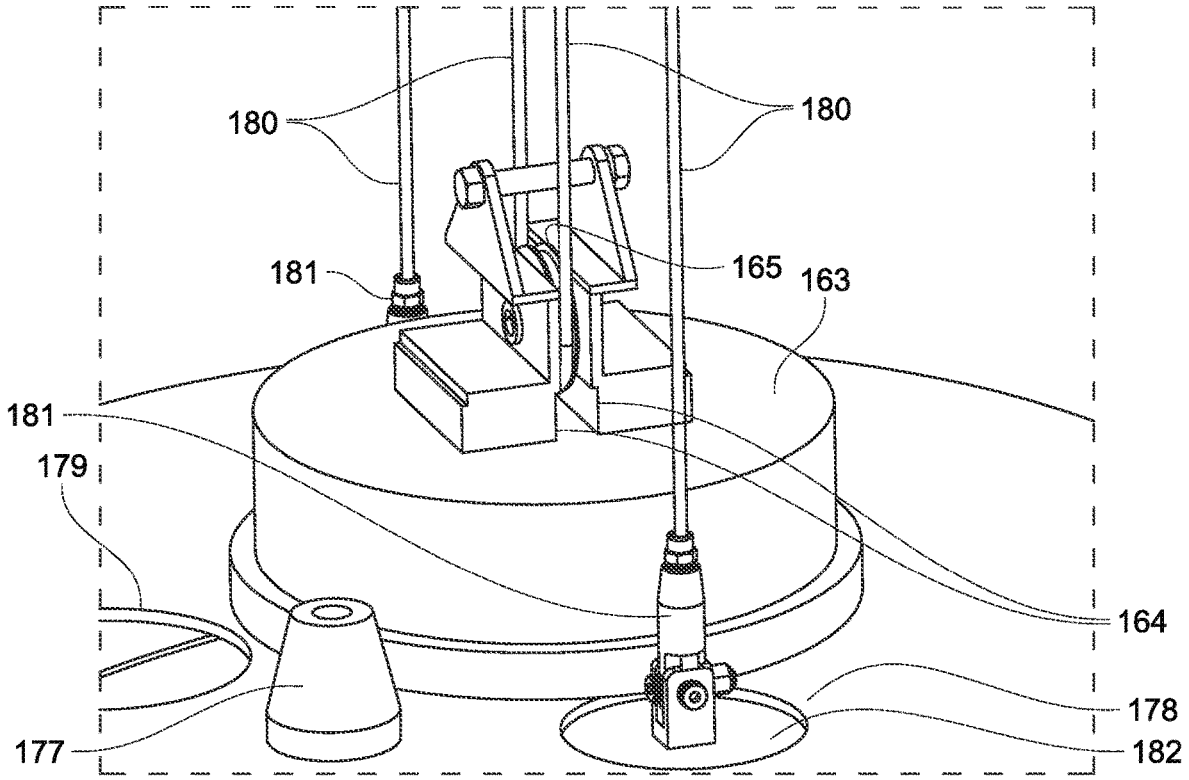
FIG. 5 is a pictorial illustration of a counterweight with a post removed from the anchoring system in accordance with an illustrative embodiment.

FIGS. 4 to 7 illustrate an assembly of the anchoring system 160 that allows the floating dock 100 to adjust positioning with the water level and/or tide changes. FIG. 4 illustrates a close-up of a top end of the post 161 with the pulley cover 166 removed. FIG. 5 illustrates a close-up view of the counterweight 163 with the post 161 removed (counterweight 163 will be disposed within the post 161). FIG. 6 illustrates a transparent view of the post to demonstrate the setup allowing the movement. As seen in the figures, the top end of the post 161 includes a pulley system 162 which is operatively connected to the counterweight 163 by the wire rope 180. As mentioned earlier, the post 161 is a hollow tube and the counterweight 163 is disposed within the post 161. The pulley system 162 includes one or more pulleys which are attached at the top end of the post 161 by a plate 162*a* with brackets 162*b*.

The one or more embodiments illustrated in the figures show the pulley system 162 with two pulleys which are opposite each other. The two pulleys are connected to the plate 162*a* which is placed over the top end of the post 161 and connected to the post 161 by the brackets 162*b*. The pulley system 162 operatively connects the counterweight 163 to the anchor fittings 178 via the wire rope 180 which work in conjunction to maintain float positioning for the floating dock 100. Once the posts 161 are floating on the water, the counterweight 163 provides the necessary tension on the wire rope 180 attached to the anchor fittings 178 as the tide and/or water levels are changing.

The counterweight 163 has a shape that is commensurate with the shape of post 161 which allows smooth movement of the counterweight 163 within the post 161. In the one or more embodiments shown in the figures, the post 161 has a round tubular shape, and thus the counterweight is also circular in shape. FIG. 5 illustrates a close-up view of the counterweight 163 as it would be disposed within the post 161. In the figure, the post 161 is removed to provide a clear view of the counterweight 163 and its components. The counterweight 163 includes the counterweight lifting attachment which comprises a bracket 164, a pulley 165, and an attachment bolt 167. The pulley 165 is sandwiched between the bracket 164 and is positioned at a relative center of the counterweight 163. The bracket 164 may be attached to the counterweight 163 by any means know in the arts that creates a strong connection, such as welding or bolts. Also seen in the illustration is the wire rope 180 which is looped through the pulley 165.

The wire rope 180 may be made of any strong material able to withstand a strong weight, water currents, and being exposed to water. An example material may include, and not be limited to, a stainless-steel wire rope.

As best seen in FIGS. 4 to 7, the wire rope 180 is connected to the counterweight 163 which is disposed within the post 161. As mentioned above, the wire rope 180 is attached to the anchor fitting 181 positioned into the ground with the disc 175. The wire rope 180 travels upward through the first thin tube 172 on the outside surface of the sleeve assembly 170. Again, the wire rope 180 running through the thin tubes 172 ensures that the wire rope 180 stays in line and prevents abrasion against the post 161. The wire rope 180 traverses upwards toward the top end of the post 161 to be positioned through a first pulley in the pulley system 162 and down into the post 161 to attach to the counterweight 163 disposed within the post 161. Specifically, the wire rope 180 is connected to the pulley 165 on the counterweight 163 allowing the wire rope 180 to loop through the pulley 165 to return up through the post 161 toward the pulley system 162 at the top end of the post 161. The wire rope 180 then loops through a second pulley in the pulley system 162 to move down along the outside of the post 161 through the second thin tube 172 on the sleeve assembly 170 to connect to the second anchor fitting 181 in the disc 175.

The counterweight 163 has a weight that provides a necessary tension to hold and maintain the floating dock 100 in position with the moving tides and water levels. For example, the counterweight 163 may weigh at least 100 pounds to provide the necessary tension. The counterweight 163 keeps a tension on the wire rope 180. As an example, when the tide recedes, the aft float 110 and/or the forward float 130 will lower downward, and the counterweight 163 will move down inside the post 161. Similarly, when the tide rises, the aft float 110 and/or the forward float 130 will rise with the high tide, and the counterweight 163 will rise in the post 161. In both scenarios, the counterweight 163 keeps constant tension on the wire rope 180 which is also held in place by the anchor fittings 178. The weight of the counterweight 163 is chosen depending on the distance between the aft float 110 and the bottom surface to provide the necessary tension on the wire rope 180 attached to the anchor fittings 178. Similarly, the weight of the counterweight 163 is also appropriately chosen for the forward float 130. As seen in FIG. 12, the forward float 130 has longer posts 161 and is placed in deeper waters, and thus the counterweight 163 will be adjusted appropriately.

The one or more floats (110, 120, 130) can also include float attachments 103 which provide additional float and wind protection. FIGS. 1 and 12 illustrate that each of the aft float 110, the center float 120, and the forward float 130 include the float attachments 103. The float attachments are included on the sides of the each of the aft, center, and forward floats 110, 120, 130. The float attachments 103 have a triangular shape which allows the wind to skim over a surface of the float attachments 103, wherein the wind is transferred over the surface of the float attachments 103 and over the top surfaces of the one or more float thus preventing disruptions to the one or more floats from the wind.

Accordingly, the present description provides for various embodiments of a floating dock assembly which has an anchoring system configured to allow the floating dock to maintain a position with the fluctuations in the tide and the water level changes. Many uses and advantages are offered by the retractable dock assembly as described above in one or more non-limiting embodiments.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A dock assembly, comprising:

a ramp extending from a bulkhead on dry land toward a body of water, the ramp having a first aft end and a first forward end, the first aft end being joined to the bulkhead via a first locking mechanism which enables rotation of the ramp with respect to the bulkhead around a first substantially horizontal axis;

an aft float configured to float on the body of water, the aft float having a second aft end and a second forward end, wherein the first forward end of the ramp is connected to a top surface of the aft float proximal to the second aft end by a second locking mechanism that enables a rotation of the aft float with respect to the ramp around a second substantially horizontal axis;

one or more anchoring systems connected to the aft float and to a sea bottom, wherein each anchoring system of the one or more anchoring systems comprises:

a post having a hollow tubular structure, the post having a top end and a bottom end, wherein a pulley system is fixed to the top end of the post, and a protective cover closes the bottom end of the post, wherein the bottom end of the post is not connected to the sea bottom;

a counterweight disposed within the post; and wherein the one or more anchoring systems anchor the aft float to the sea bottom and allow the aft float to maintain a position in relation to a water level or tide change in the body of water.

2. The dock assembly of claim 1, wherein the second forward end on the aft float is connected to a float leveling assembly which includes a bracket and one or more legs with pivoting feet, wherein the bracket connects to the aft float and the one or more legs extend perpendicularly down from the aft float.

3. The dock assembly of claim 1, wherein the aft float includes float attachments which are included on each side of a long axis of the aft float.

4. The dock assembly of claim 1, wherein each anchoring system of the one or more anchoring systems further comprises:

a sleeve assembly having a support plate which connects to the aft float, wherein the post is positioned through the sleeve assembly to connect with the aft float;

an anchor weldment having a disc with a screw, wherein the screw secures the disc to the sea bottom, and wherein the anchor weldment is connected to the counterweight through a wire rope.

5. The dock assembly of claim 4, wherein:

the anchor weldment includes two opposing wire rope fittings, a first wire rope fitting and a second wire rope fitting, which are fitted into two opposing fitting openings in the disc;

the pulley system on the top end of the post includes two pulleys positioned opposite each other; and the counterweight includes a lifting attachment comprising a bracket and a pulley wherein the pulley is sandwiched between the bracket on a top of the counterweight; and wherein the wire rope is connected to the anchor weldment, the pulley system on the top end of the post, and the counterweight disposed within the post.

6. The dock assembly of claim 5, wherein the counterweight keeps a tension on the wire rope, wherein the wire rope is connected to the anchoring system as such:

a first end of the wire rope is connected to the first wire rope fitting;

a second end of the wire rope extends upward from the first wire rope fitting, the wire rope extends upward along a length of the post to connect with a first pulley of the pulley system;

the second end of the wire rope loops through the first pulley of the pulley system and extends down into the post from the first pulley of the pulley system to connect with the pulley of the lifting attachment on the counterweight;

the second end of the wire rope loops through the pulley of the lifting attachment and extends upward through the post toward the second pulley of the pulley system;

the second end of the wire rope loops through the second pulley of the pulley system and extends downward along the length of the post; and the second end of the wire rope connects with the second wire rope fitting opposite the first wire rope fitting.

7. The dock assembly of claim 6, wherein at least four (4) anchoring systems are included on the aft float.

8. A dock assembly, comprising:

a ramp extending from a bulkhead on dry land toward a body of water, the ramp having a first aft end and a first forward end, the first aft end being joined to the bulkhead via a first locking mechanism which enables rotation of the ramp with respect to the bulkhead around a first substantially horizontal axis;

an aft float configured to float on the body of water, the aft float having a second aft end and a second forward end, wherein the first forward end of the ramp is connected to a top surface of the aft float proximal to the second aft end by a second locking mechanism that enables a rotation of the aft float with respect to the ramp around a second substantially horizontal axis;

a forward float configured to float on the body of water, the forward float connected to the aft float by a center float, the center float having a third aft end and a third forward end, and the forward float having a fourth aft end and a fourth forward end; and one or more anchoring systems connected to the aft float and/or to the forward float, wherein the one or more anchoring systems connected to the aft float and/or to the forward float connect to a sea bottom, wherein each anchoring system of the one or more anchoring systems comprises:

a post having a hollow tubular structure, the post having a top end and a bottom end, wherein a pulley system is fixed to the top end of the post, and a protective cover closes the bottom end of the post, wherein the bottom end of the post is not connected to the sea bottom;

a counterweight disposed within the post; and wherein the one or more anchoring systems anchor the aft float and/or the forward float to the sea bottom and allow the aft float and/or the forward float to maintain a position in relation to a water level or tide change in the body of water.

9. The dock assembly of claim 8, wherein a float leveling assembly is included on each of the second forward end on the aft float, and the third aft end on the center float, wherein:

each float leveling assembly includes a bracket and one or more legs with pivoting feet.

10. The dock assembly of claim 8, wherein one or more float attachments are included on each side of a long axis of the aft float, and/or each side of a long axis of the center float, and/or each side of a long axis of the forward float.

11. The dock assembly of claim 8, wherein each anchoring system of the one or more anchoring systems further comprises:

a sleeve assembly having a support plate which connects to the aft float and/or forward float, wherein the post is positioned through the sleeve assembly to connect with the aft float and/or forward float;

an anchor weldment having a disc with a screw, wherein the screw secures the disc to the sea bottom, and wherein the anchor weldment is connected to the counterweight through a wire rope.

12. The dock assembly of claim 11, wherein:

the anchor weldment includes two opposing wire rope fittings, a first wire rope fitting and a second wire rope fitting, which are fitted into two opposing fitting openings in the disc;

the pulley system on the top end of the post includes two pulleys positioned opposite each other; and the counterweight includes a lifting attachment comprising a bracket and a pulley wherein the pulley is sandwiched between the bracket on a top of the counterweight; and wherein the wire rope is connected to the anchor weldment, the pulley system on the top end of the post, and the counterweight disposed within the post.

13. The dock assembly of claim 12, wherein the counterweight keeps a tension on the wire rope, wherein the wire rope is connected to the anchoring system as such:

a first end of the wire rope is connected to the first wire rope fitting;

a second end of the wire rope extends upward from the first wire rope fitting, the wire rope extends upward along a length of the post to connect with a first pulley of the pulley system;

the second end of the wire rope loops through the first pulley of the pulley system and extends down into the post from the first pulley of the pulley system to connect with the pulley of the lifting attachment on the counterweight;

the second end of the wire rope loops through the pulley of the lifting attachment and extends upward through the post toward the second pulley of the pulley system;

the second end of the wire rope loops through the second pulley of the pulley system and extends downward along the length of the post; and the second end of the wire rope connects with the second wire rope fitting opposite the first wire rope fitting.

14. The dock assembly of claim 13, wherein at least four (4) anchoring systems are included on each of the aft float and/or forward float.

15. The dock assembly of claim 8, wherein one or more connection assemblies connect the second forward end on the aft float to the third aft end on the center float, and the third forward end on the center float to the fourth aft end on the forward float.

16. The dock assembly of claim 15, wherein each connection assembly comprises a first piece and a second piece that hingedly engage with each other, wherein each of the first piece and the second piece include:

a first attachment end opposite a first tubular end on the first piece;

a second attachment end opposite a second tubular piece on the second piece;

wherein the first and second attachment ends on the first and second piece connect to a forward end and an aft end of opposing floats, wherein the first tubular end and the second tubular end extend toward to hingedly engage with each other along a horizontal axis, where the second tubular end slidingly fits within the first tubular end, and the horizontal axis is perpendicular to a long axis of the center float.

17. A dock assembly, comprising:

a ramp extending from a bulkhead on dry land toward a body of water, the ramp having a first aft end and a first forward end, the first aft end being joined to the bulkhead via a first locking mechanism which enables rotation of the ramp with respect to the bulkhead around a first substantially horizontal axis;

an aft float configured to float on the body of water, the aft float having a second aft end and a second forward end, wherein the first forward end of the ramp is connected to a top surface of the aft float proximal to the second aft end by a second locking mechanism that enables a rotation of the aft float with respect to the ramp around a second substantially horizontal axis;

a center float configured to float on a body of water, the center float having a third aft end and a third forward end, the third aft end being connected to the second forward end on the aft float via one or more connection assemblies;

a forward float configured to float on the body of water, the forward float having a fourth aft end and a fourth forward end, the fourth aft end being connected to the third forward end via one or more connection assemblies;

the one or more connection assemblies, wherein each connection assembly comprises a first piece and a second piece that hingedly engage with each other, wherein each of the first piece and the second piece include:

a first attachment end opposite a first tubular end on the first piece; and a second attachment end opposite a second tubular piece on the second piece;

wherein the first and second attachment ends on the first and second piece connect to a forward side and an aft side of opposing floats, wherein the first tubular end and the second tubular end extend toward to hingedly engage with each other along a horizontal axis, where the second tubular end slidingly fits within the first tubular end, and the horizontal axis is perpendicular to a long axis of the center float; and one or more anchoring systems connected to the aft float and/or to the forward float, wherein the one or more anchoring systems connected to the aft float and/or to the forward float connect to a sea bottom, wherein each anchoring system of the one or more anchoring systems comprises:

a post having a hollow tubular structure, the post having a top end and a bottom end, wherein a pulley system is fixed to the top end of the post, and a protective cover closes the bottom end of the post, wherein the bottom end of the post is not connected to the sea bottom;

a counterweight disposed within the post;

an anchor weldment having a disc with a screw, wherein the screw secures the disc to the sea bottom secured to the sea bottom; and wherein a wire rope connects the anchor weldment to the counterweight disposed within the post via the pulley system on the top end of the post.

18. The dock assembly of claim 17, wherein the one or more anchoring systems anchor the aft float and/or the forward float to the sea bottom and allow the aft float and/or the forward float to maintain a position in relation to a water level or tide change in the body of water.

19. The dock assembly of claim 17, wherein a float leveling assembly is included on each of the second forward end on the aft float and the third aft end on the center float, wherein:

each float leveling assembly includes a bracket and one or more legs with pivoting feet.

20. The dock assembly of claim 17, wherein one or more float attachments are included on each side of a long axis of the aft float, and/or each side of a long axis of the center float, and/or each side of a long axis of the forward float.

21. The dock assembly of claim 17, wherein each anchoring system of the one or more anchoring systems further comprises:

a sleeve assembly having a support plate which connects to the aft float and/or forward float, wherein the post is positioned through the sleeve assembly to connect with the aft float and/or forward float.

22. The dock assembly of claim 17, wherein:

the anchor weldment includes two opposing wire rope fittings, a first wire rope fitting and a second wire rope fitting, which are fitted into two opposing fitting openings in the disc;

the pulley system on the top end of the post includes two pulleys positioned opposite each other; and the counterweight includes a lifting attachment comprising a bracket and a pulley wherein the pulley is sandwiched between the bracket on a top of the counterweight; and wherein the wire rope is connected to the anchor weldment, the pulley system on the top end of the post, and the counterweight disposed within the post.

23. The dock assembly of claim 22, wherein the counterweight keeps a tension on the wire rope, wherein the wire rope is connected to the anchoring system as such:

a first end of the wire rope is connected to the first wire rope fitting;

a second end of the wire rope extends upward from the first wire rope fitting, the wire rope extends upward along a length of the post to connect with a first pulley of the pulley system;

the second end of the wire rope loops through the first pulley of the pulley system and extends down into the post from the first pulley of the pulley system to connect with the pulley of the lifting attachment on the counterweight;

the second end of the wire rope loops through the pulley of the lifting attachment and extends upward through the post toward the second pulley of the pulley system;

the second end of the wire rope loops through the second pulley of the pulley system and extends downward along the length of the post; and the second end of the wire rope connects with the second wire rope fitting opposite the first wire rope fitting.

24. The dock assembly of claim 23, wherein at least four (4) anchoring systems are included on each of the aft float and/or forward float.

* * * * *